US010194761B1

(12) United States Patent
Yang

(10) Patent No.: US 10,194,761 B1
(45) Date of Patent: Feb. 5, 2019

(54) USER-FRIENDLY HEAVY DUTY DUAL-HOOKS PICTURE FRAME HANGER

(71) Applicant: Ue-Ming Yang, Chicago, IL (US)

(72) Inventor: Ue-Ming Yang, Chicago, IL (US)

( * ) Notice: Subject to any disclaimer, the term of this patent is extended or adjusted under 35 U.S.C. 154(b) by 0 days.

(21) Appl. No.: 15/657,747

(22) Filed: Jul. 24, 2017

(51) Int. Cl.
*A47G 1/20* (2006.01)

(52) U.S. Cl.
CPC ..... *A47G 1/205* (2013.01); *A47G 2001/207* (2013.01)

(58) Field of Classification Search
USPC .... 248/475.1, 476, 488, 489, 490, 301, 304, 248/339; 211/106.01
See application file for complete search history.

(56) References Cited

U.S. PATENT DOCUMENTS 371,665 A * 10/1887 Brinkerhoff ..... A47G 1/16 211/87.01
3,536,286 A * 10/1970 Kramer ..... A47G 25/06 211/106.01
3,782,559 A * 1/1974 Wright ..... B62H 3/12 211/113
3,955,790 A * 5/1976 Bailin ..... A47G 1/1606 248/489
4,336,884 A * 6/1982 Hart ..... A47G 1/205 206/575
4,372,450 A * 2/1983 Licari ..... A47G 25/0678 211/106.01
5,069,412 A * 12/1991 Jacob ..... A47G 1/20 248/301
7,216,841 B2 * 5/2007 Dodig, Jr. ..... A47G 1/20 248/475.1
7,798,463 B2 * 9/2010 Morgenroth ..... A47G 1/164 211/106.01
2004/0084598 A1 * 5/2004 Dodig, Jr. ..... A47G 1/20 248/475.1
2013/0168517 A1 * 7/2013 Chu ..... A47K 10/12 248/304
2017/0127867 A1 * 5/2017 Malott ..... A47G 29/00

* cited by examiner

*Primary Examiner* — Alfred J Wujciak

(57) ABSTRACT

Present invention discloses a user-friendly heavy duty dual-hooks plastic or metal hanger that has a hook-above-nail arrangement, and load capacity and structural strength equivalent to that of conventional nail-above-hook metal hanger.

2 Claims, 2 Drawing Sheets

FIG. 2

USER-FRIENDLY HEAVY DUTY DUAL-HOOKS PICTURE FRAME HANGER

BACKGROUND OF THE INVENTION

Conventional heavy-duty picture frame hanger in prior art is typically a metal hanger that is anchored to wall by nail(s) positioned above a hook. A lateral projectile is provided above the hook to guide the nail into wall in an incline position. Such a nail-above-hook arrangement is not considered user-friendly because, when user is holding picture frame above hanger in an attempt to hang the metal wire of picture frame onto the hook, he needs to maneuver metal wire to bypass the lateral projectile(s) while sliding picture frame against wall in downward direction, and then engage metal wire into the hook. Such maneuvering can be time consuming and troublesome.

Conventional hook-above-nail plastic hanger in prior art may overcome the above drawback. But up to now, it does not exist a hook-above-nail plastic hanger in prior art that is capable of offering a load capacity and structural strength equivalent to that of conventional nail-above-hook metal hanger. This is mainly due to the fact that plastic material has inherent low shear/bending strength.

One motivated concept of present invention is to improve the structural design of hook-above-nail plastic hanger, and thus provide it with structural strength and load capacity equivalent to that of conventional nail-above-hook metal hanger.

Conventional nail-above-hook metal hanger in prior art also has another drawback. In order to allow the metal wire of picture frame to bypass the lateral projectile(s) and engage into the hook below lateral projectile(s), the lateral width of lateral projectile must be restricted to a minimum.

This means that nail hole in lateral projectile can't have an adequate longitudinal length to hold and support the nail within nail hole. As a result, user needs to hold both the hanger and the small nail by hand while hammering nail into wall.

Another motivated concept of present invention is to provide the lateral projectile of a hook-above-nail hanger with a sufficient lateral width, in which, the nail hole has a sufficient length to hole and support the nail, and thus enables user to hammer nail into wall while holding only the hanger without holding the small nail by hand.

It is commonly acknowledged that two (single-hook) hangers need to be installed on wall at sufficient distance apart for hanging a relatively large size picture frame in a level position. Another motivated concept of present invention is to provide a single dual-hooks hanger capable of hanging a relatively large size picture frame in level.

By conducting extensive mechanics analyses and load tests of prototypes, author of present invention is able to develop a dual-hooks and hook-above-nail hanger that offers 50 lb. (or 70 lb.) weight load capacity, provided the hanger is anchored onto drywall with two (or three) 3 d penny size nails. This weight load capacity is equivalent to that of conventional nail-above-hook metal hanger.

In U.S. Pat. No. 7,216,841, Dodig discloses a dual-hooks and hook-above-nail hanger (FIG. 6-7). But author of present invention finds that Dodig's hanger is deemed to be a light duty hanger, and can't possibly achieve the structural strength and weight load capacity of hanger of present invention. The reasons are: (1). Dodig's hanger has a substantially smaller shear stress cross-sectional area than that of hanger of present invention. (2). Based on mechanic analyses and confirmed by actual load testing, author of present invention finds that load capacity is proportional to the height of nail hole exit above the bottom end of hanger body. Dodig's hanger is deemed to be a light-duty hanger because nail hole exit is closely adjacent to the bottom end of hanger. (3). The rear leg of U hook can easily break off from base plate due to inadequate structural strength.

In U.S. Pat. No. 5,178,355, Herzig discloses a hook-above-nail hanger, in which, a leg of U hook is used for anchoring the nail. Clearly, the leg of U hook lacks of structural strength to allow Herzig's hanger to carry large load. Herzig's hanger is also deemed to be a light-duty hanger.

SUMMARY OF THE INVENTION

One objective of present invention is to provide a picture frame hanger with a hook-above-nail arrangement, and offer such a hanger with structural strength and load capacity equivalent to that of conventional nail-above-hook metal hanger.

Another objective of present invention is to provide such a dual-hooks hanger with sufficiently long nail holes capable of guiding nails into wall in an inclined position, holding and supporting nails within the nail holes, and enabling user to hammer nails into wall while holding only the hanger without holding the nails by hand.

Another objective of present invention is to provide such a dual-hooks hanger with a central lateral projectile that makes contact with the metal wire of picture frame, and thus creates a lateral contact force for restricting slippage of metal wire within the hooks.

Another objective of present invention is to optimize the overall size of hanger, and thus minimize the gap between the wall surface and the rear surface of picture frame when picture frame is hung onto wall.

DETAILED DESCRIPTION OF THE DRAWINGS

Figure 1:
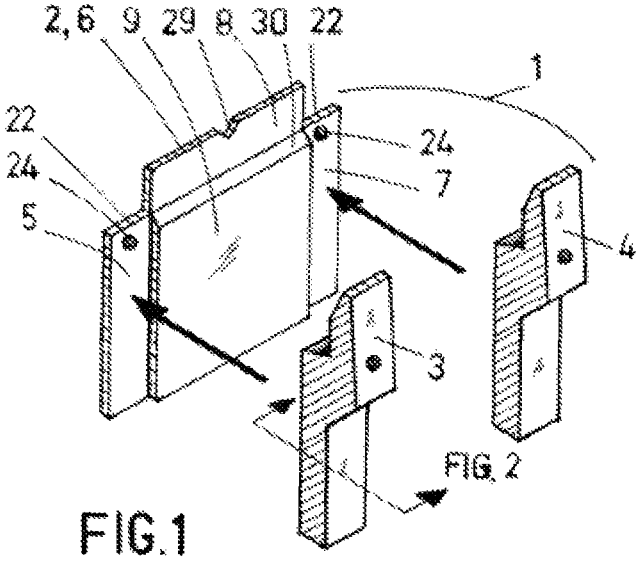
FIG. 1 shows a perspective and exploded view of the first preferred embodiment of hanger of present invention.

FIG. 1 shows a perspective and exploded view of the first preferred embodiment of hanger of present invention, in which, hanger 1 comprises of a base plate 2, and a pair of identical left and right lateral projectile 3 and 4 integrally connected to base plate 2.

Base plate 2 is divided into a left rectangular section 5, a central rectangular section 6, and a right rectangular section 7. Left section 5 has a height, width and surface area identical to that of right section 7, but smaller than that of central section 6. Central section 6 is further divided into an upper central section 8 and a lower central section 9 above and below the height of left or right section.

Left and right lateral projectiles 3 and 4 are integrally connected to the front surfaces of left and right sections 5 and 7 of base plate 2 respectively. Left or right lateral projectile 3 or 4 forms an identical left or right hook body 10. The cross-sectional view of hook body 10 is shown in FIG. 2.

Figure 2:
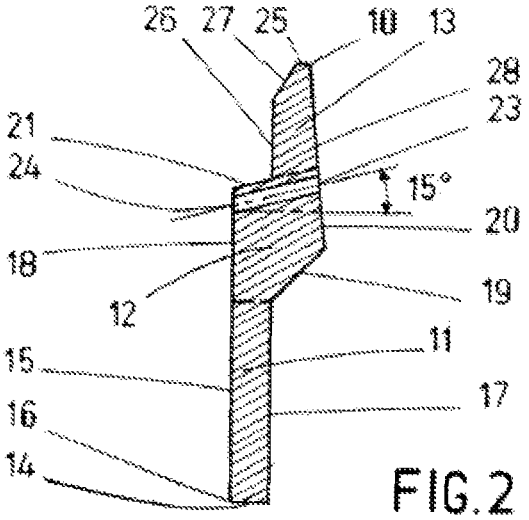
FIG. 2 shows a cross sectional view of the lateral projectile in the first preferred embodiment of hanger of present invention.

In FIG. 2, hook body 10 comprises of a lower body 11, a transition body 12 projecting upwardly and forwardly from lower body 11, and an upper body 13 projecting upwardly from the front part of transition body 12.

Lower body 11 has a bottom surface 14 and rear surface 15 emerging from the bottom edge 16, and a vertical front surface 17. Vertical rear surface 15 is flush to the vertical rear surface 18 of transition body 12. The combined rear surfaces 15 and 18 have a total surface area identical to the surface area of left or right section of base plate 2.

Transition body 12 has an inclined lower front surface 19 emerging upwardly and forwardly from the front surface 17 of lower body 11, a substantially vertical upper front surface 20 emerging from the juncture of upper and lower front surfaces 20 and 19, and an inclined open top surface 21 emerging upwardly and forwardly from the joint edge of open top surface 21 and rear surface 18, which is flush to the top surface 22 of left or right section of base plate 2.

Transition body 12 has a 15 degree inclined nail hole 23 penetrating across the upper part of transition body 12 from front surface 20 to rear surface 18, and continuously penetrating across base plate 2 to form a nail hole exit 24 at base plate 2. The incline angle of open top surface 21 is also 15 degree, so that nail hole exit 24 can be located immediately below the joint edge of open top surface 21 and rear surface 18 of transition body 12.

Upper body 13 has a top surface 25, a rear vertical surface 26 emerging from the open top surface 21 of transition body 12, a rear inclined surface 27 emerging upwardly and outwardly from rear vertical surface 26, and a substantially vertical front surface 28 flush to front surface 20 of transition body 12.

In FIG. 1, upper central section 8 of base plate 2 has a top edge, an inclined top surface emerging from the top edge to the front surface, and an indent 29 located at the top edge and the center of base plate 2 or hanger 1. Indent 29 serves as a visible marker to indicate the center of hanger, and enables user to align the center of picture frame to the center of hanger for hanging picture frame in a level position on wall.

Lower central section 9 has a wall thickness slightly greater than that of upper central section 8, which enhances the structural strength of hanger 1. Lower central section 9 has a top edge, and an inclined top surface 30 emerging from the top edge to the front surface. This top edge, which is at the same height of the top surface 22 of left or right section of base plate 2, serves as a visible marker to indicate the elevation of the internal side of bottom closed end of left or right U hook, and enables user to hang picture frame at a desired elevation on wall.

Some important design features of hanger 1 of present invention are summarized as follows:

1. The bottom edge 16 of lower body 11 is flush to the bottom surface of left or right section of base plate 2, and the bottom surface 14 of lower body 11 is preferably a horizontal surface.

The above design feature enables a conventional leveling device, which typically comprises a spirit level (i.e. bubble level) tube and a housing structure, to be removably and horizontally attached to hanger 1, and thus enables user to install hanger 1 on wall in a level position. Hanger 1 is attached to the conventional leveling device by engaging the bottom surfaces of lower bodies of left and right lateral projectiles 3 and 4 onto the horizontal top surface of the housing structure of leveling device.

2. Functionally speaking, the left or right hook body 10 may be consider as a left or right U hook even though hook body 10 is not really shown as a U-shaped hook in FIG. 1 or 2. Therefore, upper body 13 of left or right lateral projectile (3 or 4) may be considered as the front leg of said left or right U hook, open top surface 21 of transition body 12 of left or right lateral projectile (3 or 4) may be considered as the internal side of bottom closed end of said left or right U hook for retaining the hanging wire of picture frame, and upper central section 8 of base plate 2 may be considered as a common rear leg of said left and right U hooks.

The above design feature is for purpose of saving the fabrication and tooling costs of plastic injection molding of hanger 1, and enhancing the structural strength of hanger 1 by enlarging the surface area of the rear leg of U-hook. It should be noted that rear leg of U hook is subjected to bending moment and stress under loading condition.

3. Lower body 11 of left or right lateral projectile 3 or 4 has a uniform lateral thickness equal to the lateral width of open top surface 21 of transition body 12.

The above design feature enables shear stress under loading condition to be distributed in the entire cross-sectional areas of combined transition body 12 and lower body 11, and thus improves shear strength of hanger 1. It should be noted that lower body 11 also serves as a bending moment resistant cantilever under loading condition. The above design feature will also substantially increase the bending strength of lower body 11, as well as hanger 1.

4. Transition body 12 projects upwardly and forwardly from a horizontal juncture surface of lower body 11 and transition body 12, which is below the top edge of rear surface 18 of transition body 12 (i.e. the juncture of the rear surface 18 and the open top surface 21) by a vertical distance that is three times of the lateral width of open top surface 21 of transition body 12. Furthermore, the juncture edge of the front surfaces of transition body 12 and lower body 11 is separated from the rear surface of transition body 12 or lower body 11 by a horizontal distance at least equal to the lateral width of the open top surface 21 of transition body 12.

The above design feature enables transition body 12 to envelop a substantially large vertical cross-sectional area below nail hole 23 and circling around nail hole exit 24, where the maximum bending moment and bending stress occur under loading condition. As a result, hanger 1 of present invention is rigid at all time under 50 lb. loading condition.

It should be noted that the lateral width of open top surface 21 is determined by a horizontal distance between the bottom edge of the rear surface 26 of upper body 13 and the joint edge of open top surface 21 and rear surface 18.

5. Transition body 12 has an overall lateral width equal to the vertical distance between the nail hole exit 24 and the horizontal juncture surface of lower body 11 and transition body 12, and equal to 250% of the lateral width of open top surface 21 of transition body 12. The overall lateral width of transition body 12 is determined by a horizontal distance between the rear surface 18 and the juncture of front surfaces 19 and 20.

The above design feature not only enhances structure strength of transition body 12, but also enables nail hole 23 to have a sufficient longitudinal length for holding and supporting nail within nail hole 23, so that user can hammer nail into wall while holding only the hanger 1 without holding the nail by hand.

6. Upper body 13 and transition body 12 have an inclined juncture surface that is flush to the inclined open top surface 21 of transition body 12, and immediately above nail hole 23. This juncture surface has a lateral width determined by a horizontal distance between the vertical lower rear surface 26 and the front surface 28 of upper body 13, which is slightly greater than the lateral width of open top surface 21 of transition body 12. Therefore, the juncture edge of the front surfaces of upper body 13 and transition body 12 is separated from the rear surface 18 of transition body 12 by a horizontal distance at least two times of the lateral width of the open top surface 21 of transition body 12. This juncture edge is above a second juncture edge of the front surfaces of transition body 12 and lower body 11 by a vertical distance greater than the vertical distance between the second juncture edge and the top edge of rear surface 18 of transition body 12.

Because the juncture surface is immediately above nail hole 23, the area of juncture surface is subjected to impact force when user hammers nail into wall. The above design feature is for purpose of reinforcing the nail hammering area, so that upper body 13 (i.e. front leg of U hook) can't break off from transition body 12 when user hammers nail into wall.

7. Vertical lower rear surface 26 of upper body 13 has a height above the joint edge of open top surface 21 and rear surface 18 of transition body 12, which is 250% of the lateral width of open top surface 21 of transition body 12.

The above design feature provides a sufficiently deep cavity at the internal side of the bottom closed end of U hook, and thus prevents the metal wire of picture frame from accidentally falling off from U hook.

8. Nail hole exit 24 has a predetermined height of 1 inch above the bottom edge 16 of lower body 11, and the height of nail hole exit is about 90% of the height of the joint edge of open top surface 21 and rear surface 18 of transition body 12 (above the bottom edge 16 of lower body 11). Furthermore, this nail hole exit height is at least eight times of the lateral width of the open top surface 21 of transition body 12, and the ratio of this nail hole exit height to the distance between the nail hole exit 24 and the top edge of rear surface 18 of transition body 12 is 16 (i.e. 1,600%).

Based on mechanic analyses, author of present invention finds that: (1). load capacity of hanger can't be greater than the weight load that causes the anchored nail in wall to rotate to a nail pullout angle and pull nail out of wall; (2). before nail being pulled out of wall, load capacity of hanger is proportional to the height of nail hole exit above the bottom edge of hanger body; and (3). load capacity is maximized by locating nail hole exit immediately below the internal side of the bottom closed end of U-hook. As a result, in hanger of present invention, load capacity of hanger is maximized by locating the height of nail hole exit about 90% of the height of the joint edge of open top surface 21 and rear surface 18 of transition body 12.

As confirmed by load tests, the above design feature enables hanger 1 of present invention to achieve a 50 lb. weight load capacity when it is anchored to a drywall with two 3 d penny size finish nails.

9. Inclined nail hole 23 or open top surface 21 of transition body 12 has an identical 15 degree incline angle, which is substantially smaller than the typical 30-45 degree incline angle of nail hole in conventional nail-above-hook metal hanger.

Based on mechanics analyses, a larger weight load contributes a larger nail pullout angle, and load capacity of hanger is determined by the nail pullout angle rather than the incline angle of nail hole. In fact, based on mechanics analyses, nail pullout angle is proportional to the height of nail hole exit above the bottom edge of hanger body, and therefore load capacity of hanger is proportional to the height of nail hole exit above the bottom edge of hanger body.

Generally speaking, the incline angle of nail hole needs to be only some degree above zero degree (i.e. a horizontal plane), so that nail can't be accidentally pull out of wall due to a small external force. As evidenced by load testing, a typical nail pullout angle is substantially below zero degree (i.e. a horizontal plane). In prior art, there is a general conception that increasing the incline angle of nail hole results in increasing load capacity of hanger, which is totally wrong. As discussed below, author of present invention finds that decreasing the incline angle of nail hole actually increases both structural strength and load capacity of hanger.

Based on mechanics analyses, load capacity of hanger can be maximized by locating nail hole exit immediately below the internal side of the bottom closed end of U-hook. (See 8 above.) Based on the geometry of hanger 1 of present invention, nail hole exit can be located closer to the internal side of the bottom closed end of U-hook by decreasing the incline angle of nail hole. By decreasing the incline angle of nail hole, the cross-sectional area of transition body 12 below nail hole 12 increases, so as the structural strength of hanger 1 increases. By decreasing the incline angle of nail hole, the height of nail hole exit increases, so as the load capacity of hanger 1 increases.

10. Hanger 1 of present invention is provided with the optimized (i.e. minimized) overall size, particularly the lateral width of transition body 12. This design feature minimizes the gap between wall surface and rear surface of picture frame when picture frame is hung onto wall.

It is understood that some modifications to hanger 1 of present invention can be done to enhance the look of hanger without affecting its structural strength or load capacity. For example, bottom surface 14 and front surface 17 of lower body 11, front surfaces 19 and 20 of transition body 12, and front surface 28 of upper body 13 can be integrated into a continuously parabolic curve. For another example, lateral projectiles 3 and 4 and front surfaces of upper and lower central sections 8 and 9 can be integrated into a continuously streamline curve. Such modification is considered within the scope of present invention. It is also understood that some modifications to hanger 1 of present invention can be done to diversify its usage under the same objectives of hanger 1. For example, the dual-hooks hanger 1 can be converted to a single-hook hanger by means of integrally connecting the identical first and second lateral projectiles 3 and 4 to form a single lateral projectile. Such modification is considered within the scope of present invention.

Figure 3:
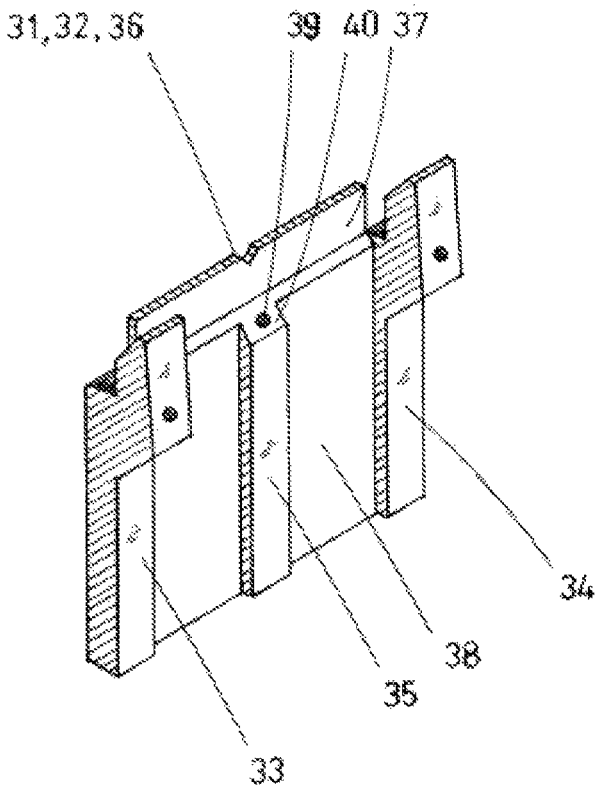
FIG. 3 shows a perspective view of the second preferred embodiment of hanger of present invention.

FIG. 3 is a perspective view of the second preferred embodiment of hanger of present invention, in which, hanger 31 comprises of a base plate 32 similar to base plate 2 of first preferred embodiment, a pair of identical left and right lateral projectiles 33 and 34 similar to left and right lateral projectiles 3 and 4 of first preferred embodiment, and a third central lateral projectile 35. Left and right lateral projectiles 33 and 34 are integrally connected to the front surfaces of left and right rectangular sections of base plate 32 respectively. Central rectangular section 36 of base plate 32 is further divided into an upper central section 37 and a lower central section 38 above and below the height of the top edge of left or right section. Third lateral projectile 35 is integrally and centrally connected to the lower central section 38, and has a 15 degree inclined nail hole 39 penetrating across from the inclined top surface 40 to rear surface, and continuously penetrates across base plate 32.

Alternatively, third lateral projectile 35 can be integrally and centrally connected across upper central section 37 and lower central section 38 of base plate 32. In which (not shown in FIG. 3), (1). third lateral projectile 35 gradually emerges downwardly and forwardly from the top edge of upper central section 37; (2). when third lateral projectile 35 emerges to an area slightly above the height of left or right section of said base plate 32, its lateral width is about equal to the lateral width of the open top surface of transition body in left or right lateral projectile 33 or 34; and (3). third lateral projectile 35 has a 15 degree inclined nail hole penetrating across in the area slightly below the height of left or right section of base plate 32, and continuously penetrating across base plate 2. As a result, third lateral projectile 35 makes contact with the metal wire of picture frame when metal wire is hung over the hooks by gravity, and thus creates a lateral contact force to restrict slippage of metal wire across the hooks.

As confirmed by load tests, hanger 31 in FIG. 3 (or in the alternative configuration as discussed above) offers a 70 lb. weight load capacity, provided it is anchored to drywall by three 3 d penny size finish nails through the inclined nail holes of left, right, and third lateral projectiles (33, 34 and 35).

It should be noted that the third central lateral projectile 35 offers another advantage. When user mounts hanger 31 onto wall, he can firstly anchor a nail through nail hole 39 in third central lateral projectile 35. By doing so, user can then adjust hanger to a level position without holding hanger because hanger is already being firmly attached to wall, but rotatable around the nail. After hanger being adjusted to a level position and the other two nails being inserted into nail holes in first and second lateral projectiles, user can then hammer nail into wall without holding either hanger or nail by hand. Hanger 1 in FIG. 1 requires user to hold hanger by hand at all time while mounting hanger 1 onto wall.

What is claimed is:

1. The heavy duty dual-hooks hanger for suspending a picture frame on a wall, comprising:

a rectangular base plate for mounting on the wall, comprising a left section, a central section and a right section, wherein the central section is boss with respect to the left and right sections, and the top part of the left section and right section comprises a nail hole;

a first lateral projectile and a second lateral projectile, each projectile comprises a lower body, a transition body, and a top body;

said lower body comprises a rectangular shape including a back surface and a front surface;

said transition body includes a front surface, a middle section and a back surface, wherein said back surface of lower body and said back surface of transition body are integral in one piece, a bottom part of said middle section extends at inclined downwardly toward to a top end of said lower body, a top part of said middle section extends at inclined upwardly toward to a bottom end of said top body;

a top end of said top body comprising a horizontal surface extending from said top end to a rear end of said top body, said rear end of top body extends at inclined downwardly toward to a rear surface of said top body, said top body comprising a rear vertical surface extending from said rear surface of top body toward a top surface of said transition body at an angle, wherein said rear surface, said rear vertical surface and said top surface of-said transition body resemble a hook shape for suspending a hanging wire of the picture frame;

said transition body comprises a nail hole extending from said front surface of transition body to said back surface of transition body at an inclined angle for nail to extend through said projectiles and said base plate to mount on the wall;

said back surfaces of first and second projectiles are integrally connected to said left section and right sections of base plate respectively, wherein said nail hole at said back surface of the transition body is aligned to said hole at said base plate, one of the edges of first projectile abuts one of the edges of boss and the other edges of first projectile aligns the end of left section, one of edges of said second projectile abuts the other edges of said boss and the other edges aligns the end of right section.

2. The heavy duty dual-hooks hanger according to claim 1, in which, said central section of said base plate comprises a nail hole, a third lateral projectile comprises an inclined nail hole in its top part, and said third lateral projectile is integrally connected to said central section of said base plate by abutting its rear surface to the front surface of said central section, and aligning said nail hole of said third lateral projectile to said nail hole at said central section of said base plate.

* * * * *